United States Patent [19]

Ericsson

[11] Patent Number: 4,781,114

[45] Date of Patent: Nov. 1, 1988

[54] SILK-SCREEN PRINTING MACHINE PROVIDED WITH A RECIPROCATINGLY MOVABLE SQUEEGEE ARRANGEMENT

[75] Inventor: Sylve J. D. Ericsson, Tumba, Sweden

[73] Assignee: Svecia Silkscreen Maskiner AB, Norsborg, Sweden

[21] Appl. No.: 880,019

[22] Filed: Jun. 30, 1986

[30] Foreign Application Priority Data

Jul. 10, 1985 [SE] Sweden ..... 8503432

[51] Int. Cl.[4] ..... B05C 17/04

[52] U.S. Cl. ..... 101/123; 101/128; 118/413

[58] Field of Search ..... 101/114, 126, 127.1, 101/128, 129, 123; 118/33, 301, 406, 413; 108/64, 102, 106

[56] References Cited

U.S. PATENT DOCUMENTS

| | | | |
|---|---|---|---|
| 707,961 | 8/1902 | Elliott . | |
| 791,450 | 6/1905 | Burdick . | |
| 2,013,089 | 9/1935 | Elliott . | |
| 2,206,176 | 3/1939 | Foard . | |
| 2,369,602 | 2/1945 | Petty et al. . | |
| 2,462,447 | 2/1949 | Wellborn . | |
| 2,684,104 | 7/1954 | Dessart et al. . | |
| 2,783,709 | 3/1957 | Thomas . | |
| 2,814,987 | 12/1957 | Foard . | |
| 2,863,382 | 12/1958 | Giani . | |
| 2,943,565 | 7/1960 | Malek . | |
| 2,991,711 | 7/1961 | Ehrhard et al. . | |
| 3,001,786 | 9/1961 | Carrozza et al. . | |
| 3,294,576 | 12/1966 | Geraghty . | |
| 3,483,819 | 12/1969 | Hughes, Jr. . | |
| 3,505,951 | 4/1970 | Gartrell | 101/123 |
| 3,513,775 | 5/1970 | Guthrie . | |
| 3,536,004 | 10/1970 | Derrickson . | |
| 3,537,406 | 11/1970 | Ort | 101/129 |
| 3,834,819 | 9/1974 | Montone . | |
| 3,943,849 | 3/1976 | Vasilantone . | |
| 4,158,507 | 6/1979 | Himmel . | |
| 4,173,928 | 11/1979 | Mitter . | |
| 4,193,344 | 3/1980 | Ericsson | 101/129 |
| 4,254,707 | 3/1981 | Lambert et al. | 101/129 |
| 4,267,773 | 5/1981 | Scherp et al. | 101/127.1 |
| 4,333,044 | 6/1982 | Blitchington . | |
| 4,383,495 | 5/1983 | Plichta et al. . | |
| 4,404,903 | 9/1983 | Cronin | 101/123 |
| 4,414,755 | 11/1983 | Ericsson . | |
| 4,459,911 | 7/1984 | Ericsson . | |
| 4,462,174 | 7/1984 | Messerschmidt | 101/127.1 |
| 4,485,447 | 11/1984 | Ericsson . | |
| 4,492,163 | 1/1985 | Ericsson . | |
| 4,516,495 | 5/1985 | Ericsson . | |
| 4,526,101 | 7/1985 | Ericsson . | |
| 4,538,358 | 9/1985 | Ericsson . | |
| 4,545,131 | 10/1985 | Ericsson . | |
| 4,551,925 | 11/1985 | Ericsson . | |
| 4,565,478 | 1/1986 | Ericsson . | |
| 4,589,335 | 5/1986 | Svantesson | 101/114 |
| 4,589,336 | 5/1986 | Klemm | 101/123 |
| 4,648,317 | 3/1987 | Bubley et al. . | |
| 4,668,329 | 5/1987 | Shirataki . | |
| 4,669,377 | 6/1987 | Ericsson et al. . | |

FOREIGN PATENT DOCUMENTS

| | | | |
|---|---|---|---|
| 197803 | 3/1978 | Fed. Rep. of Germany | 101/123 |
| 2743234 | 3/1978 | Fed. Rep. of Germany | 101/127.1 |
| 3220489 | 12/1983 | Fed. Rep. of Germany | 101/123 |
| 1178062 | 5/1959 | France . | |
| 1383023 | 11/1964 | France . | |
| 257432 | 1/1971 | U.S.S.R. . | |
| 515661 | 9/1976 | U.S.S.R. | 101/123 |
| 765022 | 9/1976 | U.S.S.R. . | |
| 525565 | 2/1977 | U.S.S.R. . | |
| 590158 | 2/1978 | U.S.S.R. . | |
| 802091 | 2/1981 | U.S.S.R. . | |
| 754220 | 8/1956 | United Kingdom . | |
| 789175 | 1/1958 | United Kingdom . | |
| 912806 | 12/1962 | United Kingdom | 101/123 |
| 2028721 | 3/1980 | United Kingdom | 101/123 |

*Primary Examiner*—E. H. Eickholt

*Attorney, Agent, or Firm*—Burns, Doane, Swecker & Mathis

[57] ABSTRACT

The present invention relates to a silk-screen printing machine provided with a reciprocatingly movable squeegee arrangement adapted for printing in both directions of squeegee travel, when caused to move over a stencil placed over a material to receive print resting on a printing table. A frame incorporating the stencil is included in a frame assembly comprising an outer and an inner unit. The two units are joined together at one edge part of the printing table. Both of the units can be raised and lowered at one edge part of the printing table, while only one of the units can be raised and lowered at the other, opposing edge part of the printing table.

8 Claims, 2 Drawing Sheets

SILK-SCREEN PRINTING MACHINE PROVIDED WITH A RECIPROCATINGLY MOVABLE SQUEEGEE ARRANGEMENT

TECHNICAL FIELD

The present invention relates to a silk-screen printing machine, and in particular to a silk-screen printing machine of the kind provided with a reciprocatingly movable squeegee arrangement adapted to enable printing to be effected in both directions of squeegee travel, the squeegee arrangement being caused to move over or across a stencil placed over a print-receiving material resting on a printing table, and in which a stencil frame is included in a frame assembly.

BACKGROUND PRIOR ART

Silk-screen printers which incorporate a reciprocatingly movable squeegee arrangement adapted to effect printing in both directions are known to the art, and as an example of the earlier known technology in this respect reference is made to the arrangement described and illustrated in German Lay-Out print No. 1 561 112.

This lay-out print describes a method of making an initial compensation for the expected total stencil stretch during a printing operation, and to permit this compensation the stencil frame or the printing table is provided with guide means. The stencil frame is arranged to be displaced axially with the aid of a mechanical device, to an extent corresponding to the total amount of stencil stretch expected, and is held firmly in this position.

Thus, there is afforded the possibility of carrying out a printing sequence in each direction of movement of the squeegee arrangement, while at the same time making the necessary, although albeit inexact compensation for stencil stretch.

The present invention can be said to take its starting point from the fundamental principles disclosed in the aforesaid German Lay-Out Print.

A silk-screen printer capable of working in accordance with the basic principles of the present invention, however, requires a further combination stage.

SUMMARY OF THE INVENTION

Technical Problem

In the case of silk-screen printing machines of the kind provided with a reciprocatingly movable squeegee arrangement which is adapted for printing in both directions of squeegee travel and which, with the aid of different known devices, is caused to move over a stencil placed over material which is to receive print and which rests on a printing table, there resides a qualified technical problem in providing conditions which enable a sufficiently large off-contact angle to be obtained readily between the stencil and said material, irrespective of the direction in which printing takes place in response to movement of the squeegee arrangement.

In the case of a silk-screen printing machine which incorporates the fundamental features disclosed in the German Lay-Out Print No. 1 561 112 and which is complemented with certain of the features disclosed in the U.S. Pat. No. 4,193,344, it will be understood that a further, highly qualified technical problem resides in the ability to perceive that the above-mentioned technical problem can be solved by an arrangement in which the frame assembly described in the aforesaid U.S. patent specification can be raised and lowered at one edge part of the printing table, while at the other, opposing edge part of the printing table solely one of the assembly units can be raised and lowered, so as to provide thereby sufficient off-contact between the stencil and the material, irrespective of the direction of movement of the squeegee arrangement.

It will be seen that another technical problem resides in the provision of simple means which enable the frame assembly to be raised or lowered in dependence on the amount of off-contact desired and the momentary position of the squeegee.

In the case of silk-screen printing machine in which measures have been taken to provide an off-contact between stencil and material of the aforesaid nature, a further technical problem resides in the provision of means for moving the stencil frame momentarily in steps along the printing table at the beginning of the squeegee travel in one printing direction, in order to compensate initially for stencil stretch, etc.

It will be seen that a further technical problem in conjunction with such momentary axial displacement of the squeegee arrangement resides in the provision of means with which the off-contact and stencil-stretch can be adjusted in dependence on the position of the squeegee.

Another technical problem is an important advantage is afforded when the squeegee arrangement comprises two mutually adjacent squeegees which are directed towards one another or angled relative to one another, of which squeegees one is intended for co-action with the stencil in a first printing direction, while the other is intended for co-action with the stencil in the opposite printing direction, which has for its purpose the elimination of complete displacement of the squeegee arrangement and an associated ink-replenishing device along the full length of the stencil for the purpose of filling the fabric or cloth with silk-screen ink or silk-screen paste, since surplus paste remaining from a printing sequence in the first direction of displacement can be pushed back by the second squeegee arrangement without requiring an intermediate filling sequence, thereby providing conditions for preventing printing paste from passing through the stencil before the squeegee arrangement has pressed the paste therethrough.

When manufacturing printed circuit cards in which the conductor array is located at a distance above the print carrier, there is also afforded the additional possibility of supplying printing paste on each side of the printed conductor array, by causing the squeegee arrangement to first move forward over the material to receive print and then to pass back over said material.

Finally, a further technical problem is one of realizing that when the squeegee arrangement is arranged for forward movement along tracks parallel to the printing table, the squeegee arrangement shall present two mutually spaced wheels or rollers located on respective sides of the stencil frame. The wheels or rollers on one side can be arranged to lie against one of the units in the first printing direction, while the other of said wheels or rollers can be arranged to lie against the other of said units in the second printing direction, these wheels or rollers contributing towards displacement of the different units of the frame assembly in a manner to achieve the aforesaid off-contact, or release, at a given angle, and so as to compensate for stencil stretch in dependence on the position of the squeegee.

SOLUTION

A silk-screen printing machine comprises a reciprocatingly movable squeegee arrangement adapted for printing in both directions of squeegee travel. The squeegee arrangement is passed or displaced over a stencil placed over a material to receive print resting on a printing table, and which further comprises a stencil frame. It is proposed in accordance with the invention that a frame assembly is capable of being raised and lowered at the one edge part of the printing table, and that a portion of said frame assembly can be raised or lowered at the other, opposing edge part of the printing table.

The stencil frame is incorporated in a frame assembly comprising an outer unit and an inner unit, which are pivotally connected together at one edge part of the printing table. The two units of the frame assembly are capable of being raised and lowered together at one edge part of the printing table and that solely one of the units can be raised or lowered at the other, opposing edge part of the printing table.

It is also proposed in accordance with the invention that there is provided a pneumatic piston-cylinder device or like mean effective to raise or to lower the units or unit to an extent dependent on a desired off-contact angle and on the location of the squeegee, and that the piston-cylinder device or like means is arranged to urge respective units towards means adapted for displacement of the squeegee, in order to obtain said off-contact angle or to compensate for stencil stretch.

In accordance with one advantageous embodiment of the invention, the edge part located at the point of origin of squeegee travel is arranged to be raised.

Means are provided for effecting momentary and stepwise displacement of the stencil frame horizontally along the printing table in one travel direction of the squeegee arrangement, to enable an initial rough compensation to be made for stencil stretch.

It also lies within the scope of the invention to obtain continuous compensation for stencil stretch in accordance with the principles illustrated and described in the U.S. Pat. No. 4,193,344.

In accordance with one particularly advantageous embodiment of the invention, the squeegee arrangement comprises two mutually adjacent squeegees which are directed towards one another and of which one squeegee is arranged to co-act with the stencil in the first printing direction, while the other squeegee is arranged to co-act with the stencil in the second, opposite printing direction.

Finally, the squeegee arrangement is arranged to be moved along tracks extending parallel with the printing table, and includes two mutually spaced wheels or rollers located on a respective side of the stencil or the printing table. One of the wheels or rollers is arranged to lie against one of the units in the first printing direction, while the other of the wheels or rollers is arranged to lie against the other of the units in the second printing direction. The abutment pressure between wheels and respective units is effected with the aid of piston-cylinder devices or like means, with which the rotational position of the units in relation to each other is determined by the prevailing location of the squeegee during a printing sequence.

ADVANTAGES

Those advantages primarily characteristic of a silk-screen printing machine constructed in accordance with the invention reside in the provision of conditions in which a reciprocatingly movable squeegee arrangement adapted for printing in both directions can be provided in an extremely simple manner, and in the creation of conditions for providing a satisfactory off-contact angle and stencil-stretch compensation, irrespective of the direction of travel of the squeegee arrangement relative to the stencil and printing table, and irrespective of the location of the squeegee along the stencil.

BRIEF DESCRIPTION OF THE DRAWINGS

A preferred embodiment of a silk-screen printing machine presenting characteristic features significant of the present invention will now be described in more detail with reference to the accompanying drawing, in which.

DESCRIPTION OF A PREFERRED EMBODIMENT

Figure 1:
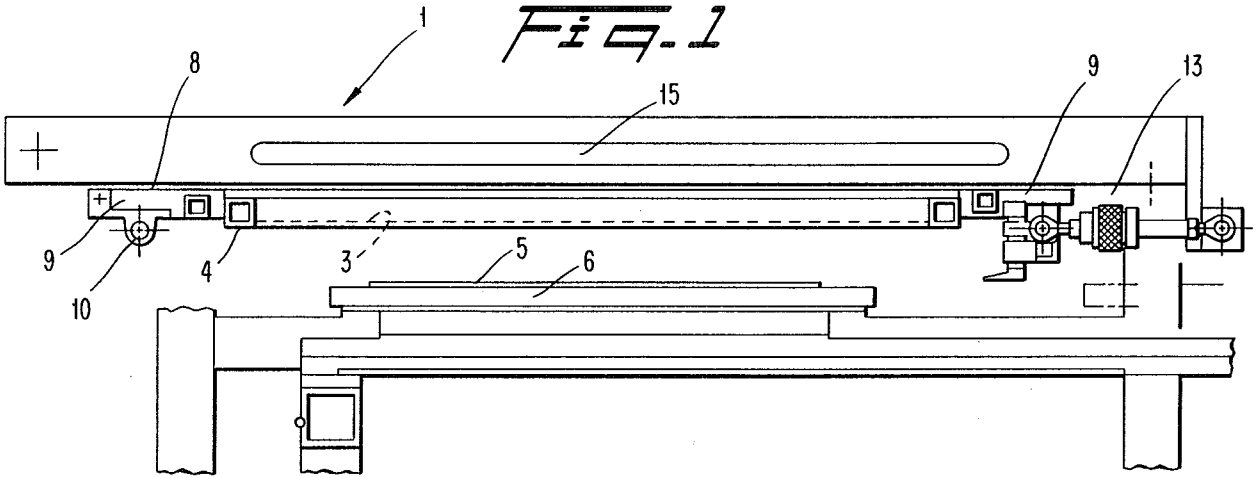
FIG. 1 is a greatly simplified illustration of the silk-screen printer is side view.

FIG. 1 is an extremely simplified illustration in side view of a silk-screen printing machine 1 provided with a reciprocatingly movable squeegee arrangement 2 for effecting printing in two directions, and also with means (not shown) for moving the squeegee arrangement over a stencil 3 stretched in a frame 4, which in turn is placed above material 5 to receive print and resting on a printing table 6.

It is emphasized that the drawings are greatly simplified, so as to be able to illustrate clearly the significant features of the invention. Accordingly, the necessary drive means, registering means etc., have been omitted from the drawing, since the manner in which such means operate is obvious to one skilled in the art.

In accordance with the invention a frame assembly incorporating the frame 4 comprises an outer unit 8 and an inner unit 9. In side view the units 8,9 are seen to lie behind one another, although the mutual positions of these units are shown more clearly in FIGS. 3, 5 and 6.

The two units 8 and 9 are pivotally connected together, or hinged, adjacent one edge part or end part 6*a* of the printing table, by means of a horizontally extending pivot shaft 10.

At this edge part, it is not possible to raise or lower solely one unit in relation to the other, but it is possible in this case to raise and lower both units together, as described in more detail hereinafter, by a pneumatic piston-cylinder device 11.

Figure 2:
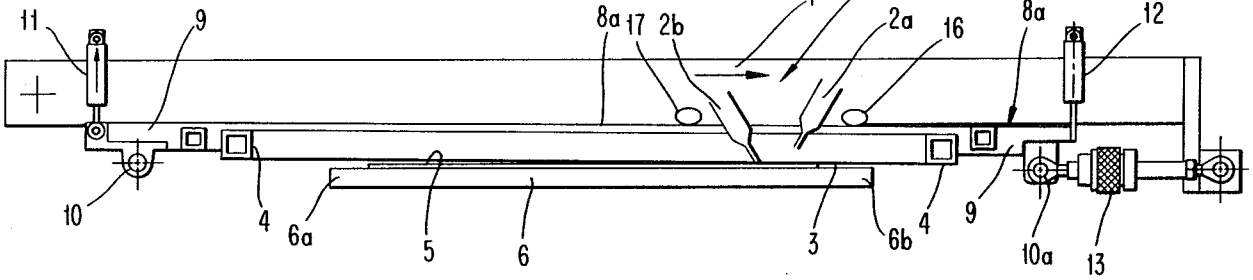
FIG. 2 illustrates components of the printer in a first direction of squeegee travel.

As shown in FIG. 2, simultaneous raising or lowering of the frame assembly unit 8,9 adjacent one edge part or one end part 6*a* of the printing table is effected with the aid of a pneumatic piston-cylinder device 11. The outer unit 8 is connected to a shaft 10*a* adjacent the other edge part 6*b* or end part 6*b* of the printing table and cannot at that part be raised or lowered.

Only one of the aforesaid units can be activated up and down at both ends, namely the inner unit 9 can also be raised and lowered at the other opposing edge part 9 be adjacent the end part 6*b* of the printing table, this being effected with the aid of a pneumatic-piston cylinder device 12.

Figure 3:
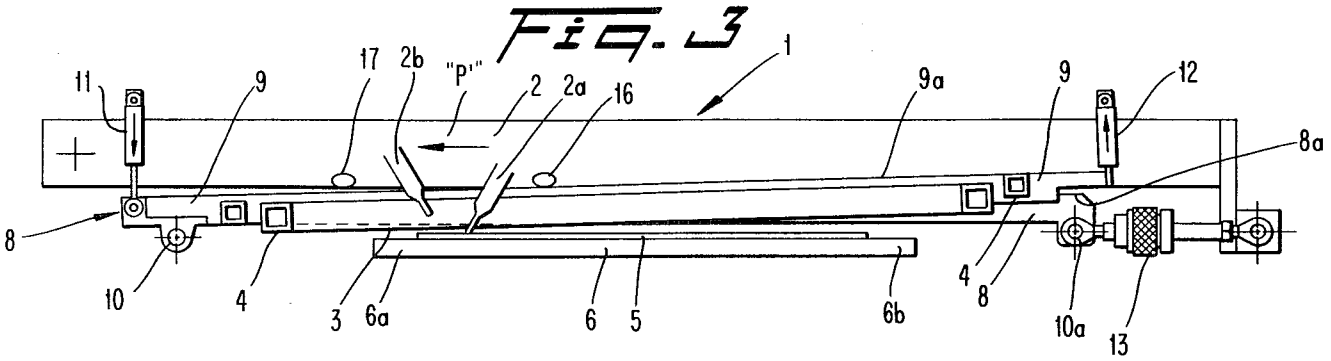
FIG. 3 is a view similar to that of FIG. 2, but illustrating the printer components in a second direction of squeegee travel, opposite to the first direction.

As will be seen from FIGS. 2 and 3, the frame 4 and the stencil are arranged to be lifted at that end thereof at which the squeegee begins to move, as illustrated by respective arrows "P" in said figures.

Means 13 are also conveniently provided in accordance with the invention for stepwise and momentary displacement of the stencil frame 4 and the frame-assembly units 8,9 along the printing table 6 in order to compensate for initial stretch in the stencil, prior to the printing.

Figure 4:
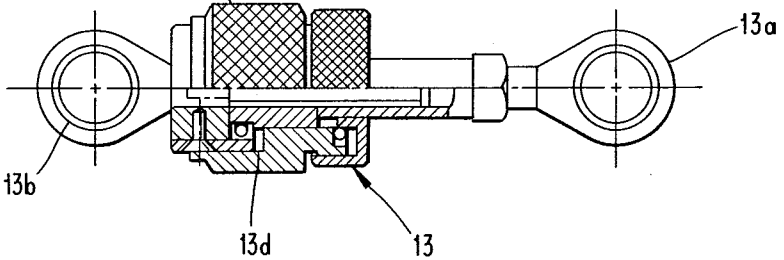
FIG. 4 illustrates proposed means for moving the stencil frame stepwise along the printing table in one direction of squeegee travel, in order to make rough compensation for stencil stretch, etc.

One such means 13 is illustrated in FIG. 4 and comprises basically two parts 13*a*, 13*b*, which can be moved axially in relation to one another by rotating a screw-threaded sleeve 13*c*. In this way there is obtained a gap or clearance 13*d*, which can be adjusted for said displacement. The actual displacement is effected with the aid of a pneumatic piston-cylinder device 14, illustrated in FIG. 6, which acts on the outer unit 8.

Turning again to FIGS. 2 and 3, it will be seen that the squeegee arrangement comprises two mutually adjacent squeegees 2*a*,2*b* which are directed towards one another and of which the one squeegee 2*a* co-acts with the stencil 3 in the first printing direction, the direction shown by arrow "P" in FIG. 2, while the other squeegee 2b co-acts with the stencil 3 in the other, opposite printing direction, shown by the arrow "P'" in FIG. 3. The mechanism for moving the squeegee is conventional and thus not shown.

The squeegee arrangement 2 is arranged to be displaced along tracks or guides which extend parallel with the printing table 6, and of which one referenced 15 is shown in FIG. 1. The squeegee arrangement further comprises two mutually spaced wheels or rollers 16,17 located on a respective side of the stencil or printing table 6. One of the two rollers 17 is arranged to lie against one of the units 8 in the first printing direction, while the other of the two rollers 16 is arranged to lie against the other of the units 9 in the other printing direction. Thus, as shown in FIG. 2, the roller or wheel 17 lies against a running surface 8*a*, while the roller or wheel 16 is free from any such surface.

FIG. 3 illustrates the other case in which the wheel or roller 16 rolls against a running surface 9*a*, while the wheel or roller 17 is free from any such surface.

This arrangement enables lifting of the respective end parts of the frame-assembly units in dependence on the position of the respective squeegee at a given time.

Figure 5:
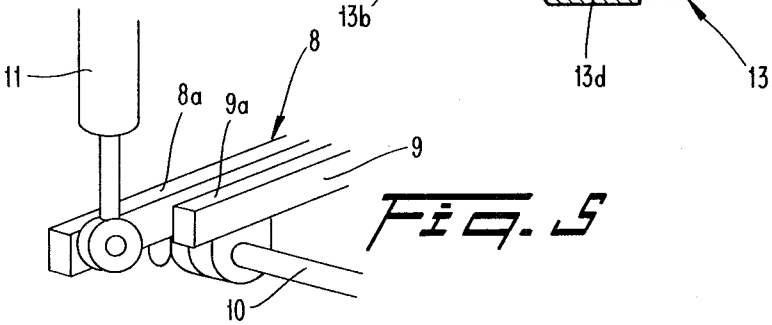
FIG. 5 illustrates in perspective a part of the outer and inner units of the frame assembly, namely the part where the outer and inner units are caused to co-act with one another at one end part of the printing table.

FIG. 5 illustrates in perspective the one end part of the frame assembly and its units 8,9, and clearly shows that the two units 8,9 are joined together through the agency of the shaft 10 and can thus be raised together with the aid of the piston-cylinder device 11, the extent to which the units can be lifted being controlled by the location of the wheel or roller 17 as is conventional.

Figure 6:
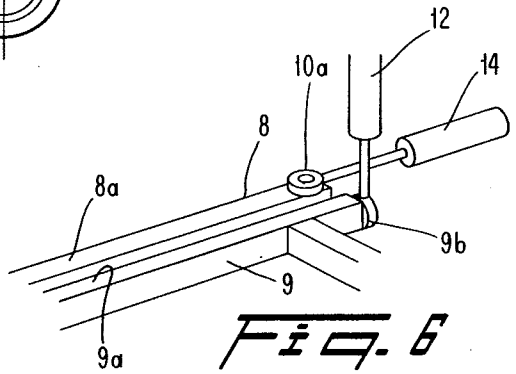
FIG. 6 illustrates in perspective a part of the outer and inner units of the frame assembly, namely the part where the outer and the inner units are caused to co-act at the other end part of the printing table.

The frame assembly and the other end part of its units 8,9 are illustrated in FIG. 6, from which it can be seen that solely the inner unit 9 can be brought to a raised position by the pneumatic piston-cylinder device 12, the extent of lift being determined by the location of the wheel or roller 16 as is conventional.

The wheels or rollers 16,17 thus hold the units 8,9 in their correct positions for compensating prevailing stencil stretch. Thus, the wheels or rollers 16 and 17 hold the units 8,9 in a partially raised position and regulate the elevated position of the respective units in dependence on the location of the wheel or roller at a given time along the tracks or guides 8*a* previously referred to.

It will be understood that the invention is not restricted to the aforedescribed and illustrated embodiment, and that modifications can be made within the scope of the following claims.

It is thus clear to a man skilled in this art that the stencil may be attached to a single frame, which can be raised or lowered or moved horizontally in dependence of the stretch at respective edge portions, for example by tilting the piston assembly in such a way that a raising of one edge portion also causes an horizontal movement of the stencil.

I claim:

1. A silk-screen printing machine having a reciprocatingly movable squeegee arrangement including at least one squeegee for printing in both directions and arranged to be passed over a stencil positioned over material to receive print and resting on a printing table, said squeegee arrangement including means for moving said squeegee, said machine further including a frame assembly comprising inner and outer frame units and a stencil frame. a first means attached to said frame assembly at one end of said frame assembly for raising and lowering said frame assembly, and a second means attached to the inner unit adjacent an opposite end of said frame assembly for raising and lowering the inner unit, activation of the first and second means for raising and lowering being in response to the location of said squeegee to thereby compensate for stretch of said stencil.

2. A silk-screen printing machine according to claim 1, whereby said stencil contacts said material to receive print so that the portion of the stencil not contacting said material to receive print defines an off-contact angle and wherein said first means for raising and lowering said frame assembly comprises a pneumatic piston-cylinder means for effecting a raising or lowering movement of the frame assembly with respect to a desired off-contact angle and the location of said at least one squeegee.

3. A silk-screen printing machine according to claim 1, wherein said first means for raising and lowering the frame assembly is connected to an edge part of the frame assembly and with respect to said reciprocatingly movable squeegee arrangement.

4. A silk-screen printing machine according to claim 1, wherein means are provided for stepwise displacement of the stencil frame along the printing table in one direction of said reciprocating squeegee arrangement for compensating stencil stretch.

5. A silk-screen printing machine according to claim 1, further including means for continuously compensating for stencil stretch relative to a position of said at least one squeegee.

6. A silk-screen printing machine according to claim 1, wherein the squeegee arrangement comprises two mutually adjacent squeegees which are directed towards one another and of which a first squeegee contacts the stencil in a first printing direction, while a second squeegee contacts the stencil in a second printing direction opposite to the first printing direction.

7. A silk-screen printing machine according to claim 1, wherein the squeegee arrangement is arranged to be displaced along tracks which extend parallel with the printing table, and in that said arrangement comprises two mutually spaced wheels or rollers located on a respective side of the printing table, of which rollers or wheels one is arranged to lie against one of the outer unit and the inner unit in the first printing direction, while the other of said wheels or rollers is arranged to lie against the other of said units in a second printing direction.

8. A silk-screen printing machine according to claim 2, characterized in that the squeegee arrangement comprises two mutually adjacent squeegees which are directed towards one another and of which a first co-acts with the stencil in a first printing direction, while a second co-acts with the stencil in a second printing direction opposite to the first printing direction.

* * * * *